US010850553B2

(12) United States Patent
Moeck

(10) Patent No.: US 10,850,553 B2
(45) Date of Patent: Dec. 1, 2020

(54) HOUSING ELEMENT FOR A WRITING INSTRUMENT AND WRITING INSTRUMENT

(71) Applicant: Gerhard Moeck, Kirchehrenbach (DE)

(72) Inventor: Gerhard Moeck, Kirchehrenbach (DE)

( * ) Notice: Subject to any disclaimer, the term of this patent is extended or adjusted under 35 U.S.C. 154(b) by 20 days.

(21) Appl. No.: 16/246,963

(22) Filed: Jan. 14, 2019

(65) Prior Publication Data

US 2019/0217656 A1 Jul. 18, 2019

(30) Foreign Application Priority Data

Jan. 12, 2018 (DE) ..... 20 2018 100 158 U

(51) Int. Cl.

| | |
|---|---|
| ***A45D 40/20*** | (2006.01) |
| ***B43K 29/18*** | (2006.01) |
| ***B43K 23/00*** | (2006.01) |
| ***B43K 31/00*** | (2006.01) |
| ***B25B 23/00*** | (2006.01) |
| ***B43K 23/10*** | (2006.01) |
| ***B43K 25/02*** | (2006.01) |
| *B25B 15/00* | (2006.01) |

(52) U.S. Cl.

CPC ..... *B43K 29/18* (2013.01); *B25B 23/0035* (2013.01); *B43K 23/00* (2013.01); *B43K 23/10* (2013.01); *B43K 25/026* (2013.01); *B43K 31/00* (2013.01); *B25B 15/007* (2013.01)

(58) Field of Classification Search

CPC ..... B43K 23/10; B43K 29/18; B43K 31/00; B25B 23/0035

USPC ..... 401/88, 89, 195

See application file for complete search history.

(56) References Cited

U.S. PATENT DOCUMENTS

| | | | | |
|---|---|---|---|---|
| 8,864,397 | B2 * | 10/2014 | Ryan | B43K 19/02 401/195 |
| 9,943,947 | B2 * | 4/2018 | Tseng | B25B 23/0035 |
| 2002/0081139 | A1 * | 6/2002 | Legg | B43K 29/18 401/195 |
| 2009/0016801 | A1 * | 1/2009 | Liu | B25F 1/02 401/116 |
| 2014/0028636 | A1 * | 1/2014 | Zhang | G06F 3/033 345/179 |
| 2015/0143966 | A1 * | 5/2015 | Pischke | B43K 23/08 81/488 |

FOREIGN PATENT DOCUMENTS

DE 202014005517 U1 9/2014

* cited by examiner

*Primary Examiner* — Jennifer C Chiang

(74) *Attorney, Agent, or Firm* — Laurence A. Greenberg; Werner H. Stemer; Ralph E. Locher

(57) ABSTRACT

A housing element for a writing instrument includes a hollow, sleeve-shaped, elongated base body having an opening for receiving the writing instrument or a pencil lead of the writing instrument at a first longitudinal end. The base body has a second longitudinal end, which is opposite the first longitudinal end, and has a retaining recess that is formed with a polygonal cross section for directly or indirectly retaining a bit in a rotationally fixed manner. A writing instrument including the housing element is also provided.

9 Claims, 1 Drawing Sheet

HOUSING ELEMENT FOR A WRITING INSTRUMENT AND WRITING INSTRUMENT

CROSS-REFERENCE TO RELATED APPLICATION

This application claims the priority, under 35 U.S.C. § 119, of German Patent Application DE 20 2018 100 158.2, filed Jan. 12, 2018; the prior application is herewith incorporated by reference in its entirety.

BACKGROUND OF THE INVENTION

Field of the Invention

The invention relates to a housing element for a writing instrument. In addition, the invention relates to a writing instrument that has such a housing element.

In addition to conventional pencils that may be sharpened—for example, graphite or colored pencils that have a mostly wood-sheathed core—writing instruments are widely used that have a durable housing in which a pencil lead or writing liquid is held. Such writing instruments include, for example, mechanical or clutch pencils, fiber pens, fountain pens or the like. Such writing instruments often also have a (pen) cap that serves to protect the writing tip (for example, the pencil lead, quill, or fiber wick).

In the skilled labor sector in particular, comparatively large pencils (also called carpentry pencils) or other writing instruments are often used, commonly with a correspondingly enlarged pencil lead. In that field especially, the above-described (housing or pencil) cap frequently serves the additional function of keeping the corresponding writing instrument easily available and accessible, for example on the work clothes of the worker. For that purpose, the cap is often enlarged into a kind of holder that surrounds not just the tip of the writing instrument, but in many cases surrounds most of the entire writing instrument.

SUMMARY OF THE INVENTION

It is accordingly an object of the invention to provide an improved housing element for a writing instrument and a writing instrument, which overcome the hereinafore-mentioned disadvantages of the heretofore-known devices of this general type.

With the foregoing and other objects in view there is provided, in accordance with the invention, a housing element for a writing instrument, including a hollow sleeve-shaped, elongated base body. This base body in turn has an opening at a first longitudinal end, for receiving either the writing instrument itself or a pencil lead for the writing instrument. The base body also has a retaining recess at a second longitudinal end opposite the first longitudinal end. The retaining recess is formed with a polygonal cross section for either directly or indirectly retaining a bit in a rotationally fixed manner.

Here and below, the term "pencil lead" refers in particular to both a "true" pencil lead that grows shorter during writing, and a fiber wick that serves to guide a writing liquid. Here and below, the term "bit" refers in particular to a tool part known as a "screwdriver bit," which serves to transmit torque to a screw. Here and below, the term "directly retaining" signifies in particular that the respective bit, when inserted normally, is inserted directly into the retaining recess. Here and below, the term "indirectly retaining" signifies in particular that when the respective bit is inserted normally, a bit holder is preferably interposed between the housing element and the bit. In the latter case, the retaining recess is constructed in particular for retaining this bit holder.

By providing the above-described retaining recess on the housing element, according to the invention it is advantageously possible to dispense with additionally carrying a corresponding tool, for example a screwdriver, when carrying the writing instrument that includes this housing element—and also at least one bit. Thus, for example, a worker inspecting a construction site, which may involve minor assembly activities at times, need not carry a screwdriver or entire screwdriver set, if the worker is carrying a writing instrument that has the housing element according to the invention. In this case, the worker needs only a bit or a few bits that are recognized to be easy to carry, e.g. in a trouser pocket.

In a preferred embodiment, the retaining recess has in particular a regular hexagonal cross-section. This means that the retaining recess is constructed in particular as an Allen wrench socket (hex key socket). The inner dimensions of the retaining recess preferably correspond to the outer dimensions on the drive side of a bit (which typically has a coupling section for coupling with a bit holder, chuck of a cordless screwdriver, or the like, in such a manner as to transmit force). For example, the retaining recess may have an inner dimension ("key width") of ¼ inch.

Preferably, the base body is tapered in the region of the second end with respect to the first end, that is, the base body has reduced outer dimensions at its second end. Regardless of that feature (but preferably in addition), the outer dimensions of the base body at the second end exceed the outer dimensions of the bit or the bit holder to such a slight degree that it is possible to retain, and transmit torque to, the bit or bit holder in a sufficiently stable manner. Through the use of such a tapering of the base body, places that are comparatively difficult to reach may be reached when inserting the base body as a tool with an inserted bit or bit holder.

In a further preferred embodiment, the housing element is a cap for the writing instrument, such as e.g. a non-mechanical pencil, mechanical pencil or the like. Particularly preferably, this cap is formed as a holder for receiving the writing instrument (in particular a cap that has greater longitudinal section than a conventional cap). In the latter case, the housing element is formed with a longitudinal extent of at least 50% of the longitudinal extent of the writing instrument.

In an alternative embodiment, the housing element is a pin housing for the writing instrument, wherein the pin housing is used in particular for retaining or mounting the pencil lead itself. In this case, the first longitudinal end of the base body constitutes the writing end of the writing instrument, the pencil lead being externally accessible for use in writing through the opening disposed at this first longitudinal end. The retaining recess for receiving the bit or bit holder is formed in this case at the writing end opposite the "back end" of the writing instrument itself.

In an expedient embodiment, the retaining recess is connected, through a shoulder that forms a bottom for the retaining recess, to an elongated inner space that the base body encircles. In other words, the bottom of the retaining recess has an opening through which the retaining recess is fluidically connected to the inner space. The shoulder forming the bottom projects, in particular radially, from a side wall of the retaining recess into the inner space of the recess. The inner space of the base body is used in particular for the situation in which the housing element is constructed at least as a cap that serves as a receptacle at least for the writing tip of the writing instrument, i.e. the tip of the pencil lead thereof. In the case of the holder, the inner space is used in particular for receiving the writing instrument itself. The opening in the bottom of the retaining recess is used, in particular in the latter case, as a kind of "drain" through which contaminants (for example dust and/or liquid) that have entered the inner space of the base body may flow or fall out. The bottom of the retaining recess, or the shoulder that serves to form the bottom, is expediently used as an axial stop for the bit or bit holder.

In a further expedient embodiment, a locking catch protrudes from at least one side wall of the retaining recess toward the inner side of the recess, in order to form-lockingly and/or force-lockingly retain the bit or the bit holder that carries the bit. Preferably, this locking catch is disposed in a corner formed between two adjoining side walls of the retaining recess. The bit or bit holder that has been inserted then is form-lockingly retained because commercially available-bits or bit holders have notches (for example, a so-called C-ring notch or a ball groove) on their drive-side coupling section (which is commonly constructed as an external hex). In this case, the locking catch is preferably disposed at a distance from the bottom of the retaining recess that corresponds to the distance from the notch to the drive-side end of the bit. If the bit inserted does not have any such notch, the locking catch gives rise to a clamping action ("force-locking") as a result of a local reduction in the inner dimension of the retaining recess. The locking catch thus advantageously prevents the bit or bit holder from slipping out of the retaining recess due to the effect of gravity or a slight withdrawal force.

A form-locking connection is one which connects two elements together due to the shape of the elements themselves, as opposed to a force-locking connection, which locks the elements together by force external to the elements.

In one embodiment, alternatively or optionally in addition to the locking catch described above, magnetic material for magnetically retaining the bit, or the bit holder carrying the bit, is disposed in the region of the bottom of the retaining recess. For example, the shoulder that forms the bottom of the retaining recess may itself be formed from this magnetic material, for example, from a neodymium compound. Alternatively, a plate formed from this magnetic material, or a ring, is introduced into the inner space of the base body and connected, e.g. glued, into the retaining recess or onto the shoulder.

In order to allow the greatest possible freedom of design in the formation of the base body, in an advantageous embodiment, it is injection-molded from plastic. Preferably, the plastic used is a fiber-reinforced plastic, for example a (short glass) fiber-reinforced polyamide or the like. As a result of the fiber reinforcement, the base body has a comparatively high rigidity, thus making it possible to transmit a comparatively high torque to the bit with low risk of deforming the base body in the region of the retaining recess, for example bursting the retaining recess. Optionally, it is also possible that the base body is manufactured in a multi-component injection molding process, wherein for example a region amounting to one third of the total length of the base body, around the second end that has the retaining recess, is made from the fiber-reinforced plastic, and the remaining areas of the base body are made from an unreinforced plastic (for example, respectively, a polyamide).

In a further expedient embodiment, the base body has a grip structure on its outside. In particular, the base body is formed with a polygonal and/or oval outer profile. As a result, the handling of the housing element is improved when a bit is used for screwing a screw in or out.

In a further expedient embodiment, the housing element includes a mounting bracket that is connected with the base body, preferably integrally (i.e. monolithically or in one piece), by using a fixed end in the region of the opening (i.e. the first end). This mounting bracket is oriented toward the second end of the base body by using its free end, which faces away from the fixed end. The mounting bracket is used in particular for a clamping retention of the entire housing element, and preferably of the holder that the housing element forms, to a garment of a user of the housing element or of the writing instrument that includes it. The mounting bracket, in this case, is disposed on the base body in such a way that when the housing element is clamped to the garment, for example, in a pocket, the opening that serves to accommodate the writing instrument is open toward the same direction as the pocket. In this way, the writing instrument is directly accessible from the outside of the pocket, and the holder may remain on the garment (as such a holder typically would) when the writing instrument is being used for writing or drawing.

With the objects of the invention in view, there is concomitantly provided a writing instrument including the housing element described above. In a variant, this housing element, as described above, is the housing element that holds the pencil lead, i.e., in particular, the (in particular permanent) body of the writing instrument itself. In an alternative variant, however, the housing element is the above-described cap, in particular the holder that is intended to be used with the writing instrument. In the latter case, the inner space of the base body of the housing element is preferably adapted specifically to the writing instrument it is intended to accommodate.

Here and below, the conjunction "and/or" signifies in particular that the features linked by this conjunction may be constructed not only jointly, but also as alternatives to one another.

Other features which are considered as characteristic for the invention are set forth in the appended claims.

Although the invention is illustrated and described herein as embodied in a housing element for a writing instrument and a writing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
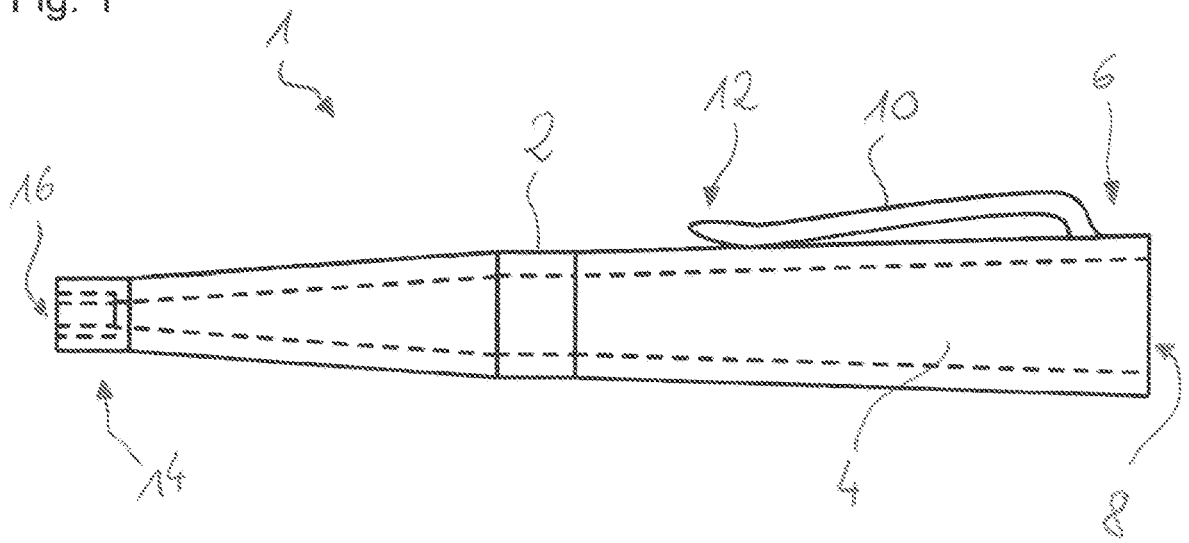
FIG. 1 is a diagrammatic, side-elevational view of a housing element for a writing instrument.
Figure 2:
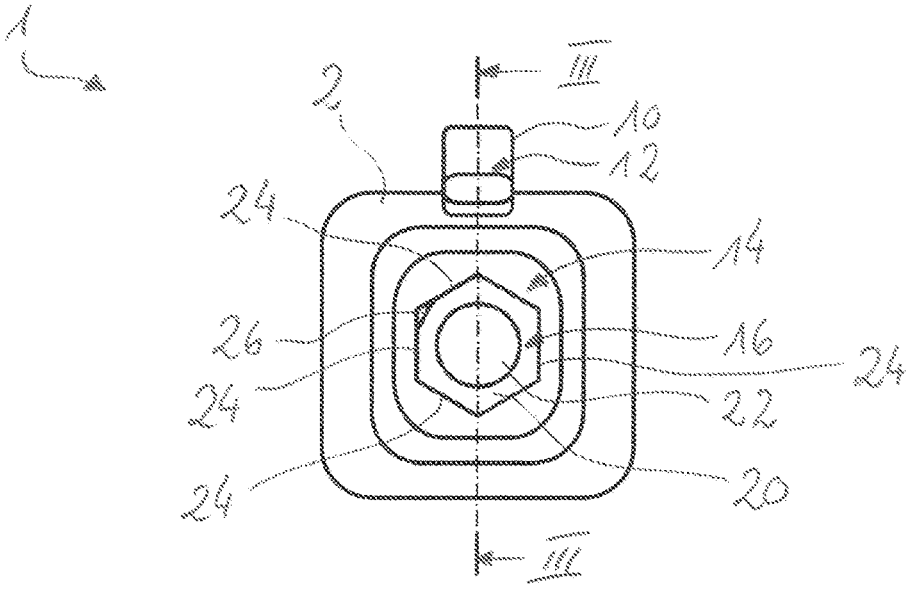
FIG. 2 is a diagrammatic, front-elevational view of the housing element.
Figure 3:
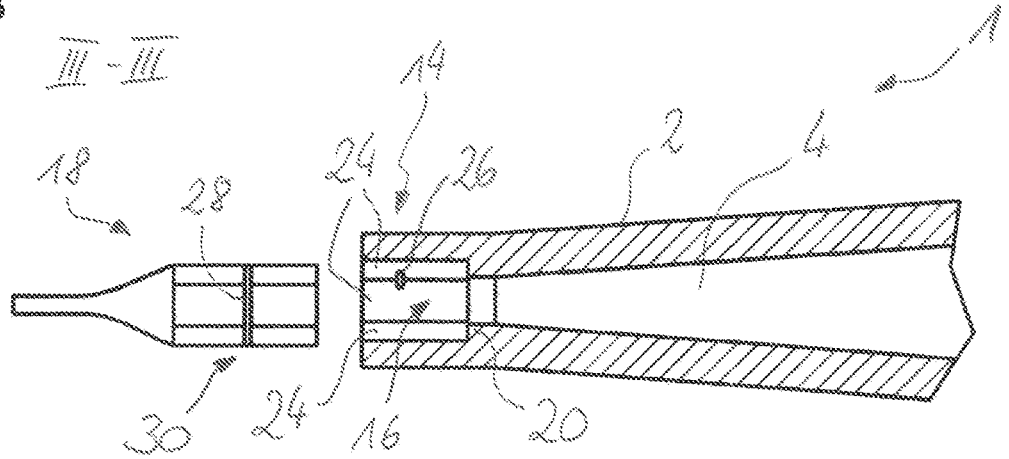
FIG. 3 is a fragmentary, partly sectional view, taken along a line III-III of FIG. 2 in the direction of the arrows, showing the housing element together with a bit to be held thereon.

Referring now in detail to the figures of the drawings, in which corresponding parts and sizes are always assigned the same reference numerals, and first, particularly, to FIGS. 1-3 thereof, there is seen a diagrammatic depiction of a housing element for a writing instrument, specifically a holder 1 for a carpenter's mechanical pencil (not shown in detail). The holder 1 includes a hollow, sleeve-shaped and elongated base body 2. The base body 2 encircles an inner space 4 (indicated in FIG. 1 by hidden edges). The inner space 4 is open to the environment at a first end of the base body 2, hereinafter referred to as the "insertion end 6," through an opening hereinafter referred to as the "insertion opening 8." The insertion opening 8 serves to receive the writing instrument into the holder 1. In the region of the insertion end 6, the holder 1 has a mounting bracket 10 that is fastened to the base body 2 at a distance from the insertion end 6 that is slight compared to the total length of the holder 1, and specifically compared to the total length of the base body 1. Specifically, the mounting bracket 10 is formed integrally with the base body 2. The mounting bracket 10 is oriented with its free end 12 (or "clamping end") toward the insertion end 6 opposite the second end of the base body 2, hereinafter referred to as the "tip end 14." At the tip end 14, the base body 2 of the holder 1 is constructed with reduced outer dimensions relative to the insertion end 6. In addition, a retaining recess 16 is introduced into the base body 2 at the tip end 14, and this retaining recess has a profile in the form of a regular hexagon (see FIG. 2). The retaining recess 16 is specifically constructed for receiving a bit 18 (see FIG. 3) or a bit holder.

As may be seen in FIGS. 2 and 3, the retaining recess 16 is bounded on the bottom side, i.e. in the direction of the insertion end 6, by a shoulder 20 that projects toward the inside of the recess, i.e. toward a longitudinal axis of the retaining recess 16. The shoulder 20 does not completely close off the retaining recess 16 on the bottom side; rather, it keeps an opening 22 open between the retaining recess 16 and the inner space 4.

In order to allow the bit 18 or bit holder to be sufficiently securely retained in the withdrawal direction of the bit 18 or bit holder, a locking catch 26 is formed in a corner between two side walls 24 of the retaining recess 16. This locking catch 26 is constructed in a manner corresponding to a notch 28 that is often present in bits 18. Such a notch 28 is commonly formed on a (drive-side) coupling section 30 of the bit 18. This coupling section 30 has a hexagonal outer profile for coupling with a bit holder, a chuck of a cordless screwdriver or the like, in such a manner as to transmit force. The notch 28 in this case is commonly formed at least in the corners of the coupling section 30 or as a ring encircling that section. When the bit 18 is inserted inside a bit holder, C-rings or the like are often present in this notch 28 for form-lockingly retaining the bit 18*a*. In the illustrated example of the holder 1, when normally coupled, the locking catch 26 engages in the notch 28 and thus form-lockingly retains the bit 18 in the retaining recess 16.

In the illustrated exemplary embodiment, the bit 18 is formed in longitudinal slot shape, for coupling with a screw head. In other words, the illustrated bit 18 serves as a "slot screwdriver."

It may also be seen from FIG. 2 that the base body 2 has a polygonal outer profile, and specifically a rounded quadrangular outer profile. This outer profile forms a grip structure that makes it possible to securely grip the holder 1 when using the holder 1 as a screwdriver.

The subject matter of the invention is not limited to the exemplary embodiment described above. A person of ordinary skill in the art will be able to derive additional embodiments of the invention from the foregoing description.

The following is a summary list of reference numerals and the corresponding structure used in the above description of the invention:

1 Holder
2 Base body
4 Inner space
6 First end
8 Insertion opening
10 Mounting bracket
12 Free end
14 Tip end
16 Retaining recess
18 Bit
20 Shoulder
22 Opening
24 Side wall
26 Locking catch
28 Notch
30 Coupling section

The invention claimed is:

1. A housing element for a writing instrument, the housing element comprising:

a hollow, sleeve-shaped, elongated base body having mutually opposite first and second longitudinal ends;

said base body having an opening at said first longitudinal end for receiving the writing instrument or a pencil lead of the writing instrument; and said base body having a retaining recess formed with a polygonal cross section at said second longitudinal end for directly or indirectly retaining a bit in a rotationally fixed manner;

said retaining recess having side walls and a locking catch protruding from at least one of said side walls for at least one of form-lockingly or force-lockingly retaining the bit or a bit holder carrying the bit;

said locking catch protruding from a corner formed between an adjoining two of said side walls toward an inner side of said retaining recess.

2. The housing element according to claim 1, wherein said polygonal cross section of said retaining recess is a hexagonal cross section.

3. The housing element according to claim 1, wherein the housing element is a holder for the writing instrument.

4. The housing element according to claim 1, wherein said base body encircles an elongated inner space, said retaining recess has a shoulder forming a bottom for said retaining recess, and said shoulder connects said retaining recess to said elongated inner space.

5. The housing element according to claim 1, wherein said retaining recess has a bottom and magnetic material disposed in a region of said bottom for magnetically retaining the bit or a bit holder carrying the bit.

6. The housing element according to claim 1, wherein said base body is an injection-molded plastic body.

7. The housing element according to claim 1, wherein said base body has an exterior with a grip structure.

8. The housing element according to claim 1, which further comprises a mounting bracket connected to said base body, said mounting bracket having a fixed end in a vicinity of said first longitudinal end of said base body and a free end oriented toward said second longitudinal end of said base body.

9. A writing instrument, comprising a housing element according to claim 1.

* * * * *